US006625000B2

(12) United States Patent
Jakwani et al.

(10) Patent No.: US 6,625,000 B2
(45) Date of Patent: Sep. 23, 2003

(54) MODULAR STRUCTURES FOR TRANSIENT VOLTAGE SURGE SUPPRESSORS

(75) Inventors: Asif Y. Jakwani, Dallas, TX (US); Paul Jeffries, Grapevine, TX (US); Fyodor M. Shterenberg, Plano, TX (US); Getzel Gonzalez Garcia, Flower Mound, TX (US)

(73) Assignee: Current Technology, Inc., Irving, TX (US)

( * ) Notice: Subject to any disclaimer, the term of this patent is extended or adjusted under 35 U.S.C. 154(b) by 74 days.

(21) Appl. No.: 09/804,598

(22) Filed: Mar. 12, 2001

(65) Prior Publication Data

US 2002/0048132 A1 Apr. 25, 2002

Related U.S. Application Data

(60) Provisional application No. 60/241,954, filed on Oct. 21, 2000.

(51) Int. Cl.[7] ..... G08B 21/00

(52) U.S. Cl. ..... 361/118; 361/735; 361/733; 361/732; 361/731; 361/728

(58) Field of Search ..... 361/111, 118, 361/54, 56, 62, 728–731, 733, 735

(56) References Cited

U.S. PATENT DOCUMENTS

| | | | | |
|---|---|---|---|---|
| 3,177,405 A | | 4/1965 | Gray | |
| 4,642,733 A | | 2/1987 | Schacht | |
| 4,794,485 A | | 12/1988 | Bennett | |
| 4,876,626 A | | 10/1989 | Kaczmarek | |
| 5,053,919 A | | 10/1991 | Schacht | |
| 5,311,393 A | | 5/1994 | Bird | |
| 5,341,509 A | * | 8/1994 | Takashima | 710/317 |
| 5,500,782 A | | 3/1996 | Oertl | |
| 5,508,873 A | | 4/1996 | Knapp et al. | |
| 5,701,227 A | | 12/1997 | Ryan | |
| 5,953,193 A | | 9/1999 | Ryan | |
| 5,966,282 A | | 10/1999 | Ryan et al. | |
| 5,969,932 A | | 10/1999 | Ryan et al. | |

* cited by examiner

*Primary Examiner*—Brian Sircus
*Assistant Examiner*—Isabel Rodriguez

(57) ABSTRACT

Improved modular transient voltage surge suppressor apparatus are disclosed that equalize transient current sharing between multiple modules. In general, such apparatus includes first and second transient voltage surge suppression modules, each module having a non-conductive housing with a surge suppression circuit contained therein, and first and second electrically-conductive buses mechanically coupled to the non-conductive housing and electrically coupled to first and second terminals of the surge suppression circuit, respectively. A first bus coupler couples the first electrically-conductive buses of the first and second transient voltage surge suppression modules and a second bus coupler couples the second electrically-conductive buses of the first and second transient voltage surge suppression modules, whereby the surge suppression circuits in each of the first and second modules are electrically coupled in parallel. A first electrical conductor coupler is electrically coupled to, and physically located proximate, the first electrically-conductive bus of the first transient voltage surge suppression module, and a second electrical conductor coupler is electrically coupled to, and physically located proximate, the second electrically-conductive bus of the second transient voltage surge suppression module, whereby the electrical path length from the first electrical conductor coupler to the second electrical conductor coupler and through the surge suppression circuit of the first transient voltage surge suppression module is substantially equal to the electrical path length from the first electrical conductor coupler to the second electrical conductor coupler and through the surge suppression circuit of the second transient voltage surge suppression module.

17 Claims, 7 Drawing Sheets

MODULAR STRUCTURES FOR TRANSIENT VOLTAGE SURGE SUPPRESSORS

CLAIM OF BENEFIT UNDER 35 U.S.C. §119(e)

This application claims the benefit of U.S. Provisional Application No. 60/241,954, filed Oct. 21, 2000.

TECHNICAL FIELD OF THE INVENTION

The present invention is directed, in general, to transient voltage surge suppression apparatus and, more specifically, to improved modular designs for such apparatus.

BACKGROUND OF THE INVENTION

For many years, manufacturers of electronic systems have recommended that users take measures to isolate their hardware from transient overvoltages (also called "surges") that may cause damage to sensitive electronic devices. Transient voltage protection systems (so-called "surge suppressors") are designed to reduce transient voltages to levels below hardware-damage susceptibility thresholds; providing such protection can be achieved through the use of various types of transient-suppressing elements coupled between the phase, neutral and/or ground conductors of an electrical distribution system.

Conventional transient-suppressing elements typically assume a high impedance state under normal operating voltages. When the voltage across a transient-suppressing element exceeds a pre-determined threshold rating, however, the impedance of the element drops dramatically, essentially short-circuiting the electrical conductors and "shunting" the current associated with the transient voltage through the element and thus away from the sensitive electronic hardware to be protected.

To be reliable, a transient-suppressing element itself must be capable of handling many typical transient-voltage disturbances without internal degradation. This requirement dictates the use of heavy-duty components designed for the particular transient voltage environment in which such elements are to be used. In environments characterized by high-magnitude or frequently-occurring transients, however, multiple transient-suppressing elements may be required.

In many applications, the transient-suppressing elements typically employed are metal-oxide varistors ("MOVs"); silicon avalanche diodes (SADs) and gas tubes are other types of transient-suppressing elements. When designing a system incorporating MOVs it is important to recognize the limitations of such devices, and the effects that the failure of any given MOV may have on the integrity of the total system. All MOV components have a maximum transient current rating; if the rating is exceeded, the MOV may fail. An MOV component may also fail if subjected to repeated operation, even if the maximum transient current rating is never exceeded. The number of repeated operations necessary to cause failure is a function of the magnitude of transient current conducted by an MOV during each operation: the lower the magnitude, the greater the number of operations necessary to cause failure. A designer of transient voltage protection systems must consider these electrical environment factors when selecting the number and type of MOVs to be used in a particular system. Therefore, to design a reliable transient voltage suppression system, a designer must consider both the maximum single-pulse transient current to which the system may be subjected, as well as the possible frequency of transients having lower-level current characteristics.

Although individual MOVs have a maximum transient current rating, it is possible to construct a device using multiple MOVs, in parallel combination, such that the MOVs share the total transient current. In this manner, each individual MOV must only conduct a fraction of the total transient current, thereby reducing the probability that any individual MOV will exceed its rated maximum transient current capacity. Furthermore, by using a plurality of individual MOVs, a transient voltage protection system can withstand a greater number of operations because of the lower magnitude of transient current conducted by each individual MOV.

When a transient voltage suppression system incorporates multiple MOVS, it is important that the system be designed such that the failure of an individual MOV does not cause a complete loss of system functionality. When an MOV fails, due to either exceeding its maximum transient current rating or frequent operation, it initially falls into a low impedance state, drawing a large steady-state current from the electrical distribution system. This current, if not interrupted, will quickly drive an MOV into thermal runaway, typically resulting in an explosive failure of the MOV.

To avoid the explosive failure of MOVs, an appropriately-rated current-limiting element, such as a fuse, should be employed in series with MOVs. If the transient-suppressing device incorporates a plurality of parallel-coupled MOVs, however, a single fuse in series with the parallel combination of MOVs may open-circuit even if only a single MOV fails, resulting in a disconnection of the remaining functional MOVs from the electrical distribution system. Therefore, better-designed systems incorporate individual fuses for each MOV, such that the failure of an individual MOV will result only in the opening of the fuse coupled in series with the failed MOV; the remaining functional MOVs remain connected to the electrical distribution system, via their own fuses, to provide continued transient voltage protection.

In the prior art, there are transient suppression circuits that incorporate a plurality of parallel-coupled MOVs with an individual fuse provided for overcurrent protection of the MOVs. U.S. Pat. No. 5,153,806 to Corey teaches the use of a single fuse to protect a plurality of MOVs, as well as an alarm circuit for indicating when the fuse has open-circuited. Similarly, U.S. Pat. No. 4,271,466 to Comstock teaches the use of a single fuse in series with a plurality of MOVs, as well as a light-emitting diode ("LED"), coupled in parallel with the fuse, to emit light when the fuse is blown. The deficiencies of these types of circuits is that the failure of a single MOV can cause the fuse to fail whereby the remaining functional MOVs are decoupled from the circuit; i.e., the remaining functional MOVs are disconnected from the electrical distribution system and thus cannot provide continued protection from transient voltages.

There are also a limited number of transient suppression devices that employ multiple over-current limiting elements with multiple parallel-coupled MOVs or other transient suppression devices. Such devices known in the prior art, however, typically employ a bare fusible element mounted on the printed circuit board on which the MOVs are mounted. When an MOV associated with a particular fusible element fails, the fusible element typically open circuits. The open-circuiting of a fusible element is often accompanied by electrical arcing, which is particularly true in the area of transient suppression devices because of the large voltages and currents usually present when a suppression device fails. Because of the close proximity of the bare fusible elements, the electrical arcing of one fusible element can result in the destruction of adjacent elements, thereby decoupling remaining functional MOVs from the circuit and further limiting the remaining suppression capacity of the device.

The inadequacy of the prior art is that the failure of a single MOV component may cause a current-limiting element, such as a fuse, in series with a plurality of parallel-coupled MOVs to open-circuit, thus eliminating all transient voltage suppression capability of the parallel-coupled MOVs. In prior art circuits that have employed multiple current-limiting elements with multiple parallel-coupled MOVs (or other transient suppression devices), the failure of a current-limiting element can cause electrical arcing that can result in the destruction of adjacent current-limiting elements, or MOVs, thus resulting in further degradation of the suppression capacity of the circuit. Therefore, there is a need in the art for improved apparatus for providing over-current protection to a plurality of parallel-coupled transient-suppression devices; such improved apparatus preferably reduce, or eliminate, the possibility of failures due to electrical-arcing.

As described supra, it is known in the prior art to provide multiple MOVs, in parallel combination, such that the MOVs share the total transient current. Furthermore, such circuits can be housed in individual modules, and multiple modules can be coupled in parallel to increase the surge capacity of the device. Examples of prior art modular devices are disclosed by Ryan, et al. in U.S. Pat. Nos. 5,701,227, 5,953,193, 5,966,282, and 5,969,932, incorporated herein by reference. A particular inadequacy of such prior art modular devices, however, is the manner in which the modules are coupled together, which requires each module in a stack of modules to be independently coupled to each adjacent module. This manner of assembly increases not only the number of physical parts, but also the assembly time, as well as the disassembly time required to repair or replace a failed module. Accordingly, there is a further need in the art for improved modular structures for housing transient voltage suppression circuits.

SUMMARY OF THE INVENTION

To address certain above-described deficiencies of the prior art, the present invention provides improved modular transient voltage surge suppressor apparatus that equalize transient current sharing between multiple modules. In general, such apparatus includes first and second transient voltage surge suppression modules, each module having a non-conductive housing with a surge suppression circuit contained therein, and first and second electrically-conductive buses mechanically coupled to the non-conductive housing and electrically coupled to first and second terminals of the surge suppression circuit, respectively. A first bus coupler couples the first electrically-conductive buses of the first and second transient voltage surge suppression modules and a second bus coupler couples the second electrically-conductive buses of the first and second transient voltage surge suppression modules, whereby the surge suppression circuits in each of the first and second modules are electrically coupled in parallel. A first electrical conductor coupler is electrically coupled to, and physically located proximate, the first electrically-conductive bus of the first transient voltage surge suppression module, and a second electrical conductor coupler is electrically coupled to, and physically located proximate, the second electrically-conductive bus of the second transient voltage surge suppression module, whereby the electrical path length from the first electrical conductor coupler to the second electrical conductor coupler and through the surge suppression circuit of the first transient voltage surge suppression module is substantially equal to the electrical path length from the first electrical conductor coupler to the second electrical conductor coupler and through the surge suppression circuit of the second transient voltage surge suppression module.

In a specific embodiment illustrated and described hereinafter, such apparatus includes a substrate, with first and second mounting posts coupled to and extending substantially perpendicular thereto. First and second transient voltage surge suppression modules mounted on the mounting posts each include a non-conductive housing having a surge suppression circuit contained therein, and first and second electrically-conductive buses mechanically coupled to the non-conductive housing and electrically coupled to first and second terminals of the surge suppression circuit, respectively. The first and second electrically-conductive buses include a bore therethrough for slidably mounting the transient voltage surge suppression modules on the first and second mounting posts; the bores have internal profiles corresponding to the external profiles of the mounting posts. The first transient voltage surge suppression module is mounted on the first and second mounting posts adjacent to the substrate and the second transient voltage surge suppression module is mounted on the first and second mounting posts adjacent to the first transient voltage surge suppression module, whereby the surge suppression circuits in each of the first and second modules are electrically coupled in parallel. A first electrical conductor coupler is electrically coupled to, and physically located proximate, the first electrically-conductive bus of the first transient voltage surge suppression module, and a second electrical conductor coupler is electrically coupled to, and physically located proximate, the second electrically-conductive bus of the second transient voltage surge suppression module, whereby the electrical path length from the first electrical conductor coupler to the second electrical conductor coupler and through the surge suppression circuit of the first transient voltage surge suppression module is substantially equal to the electrical path length from the first electrical conductor coupler to the second electrical conductor coupler and through the surge suppression circuit of the second transient voltage surge suppression module.

The foregoing has outlined rather broadly the features and technical advantages of the present invention so that those skilled in the art may better understand the detailed description of the invention that follows. Additional features and advantages of the invention will be described hereinafter that form the subject matter of the claims recited hereinafter. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
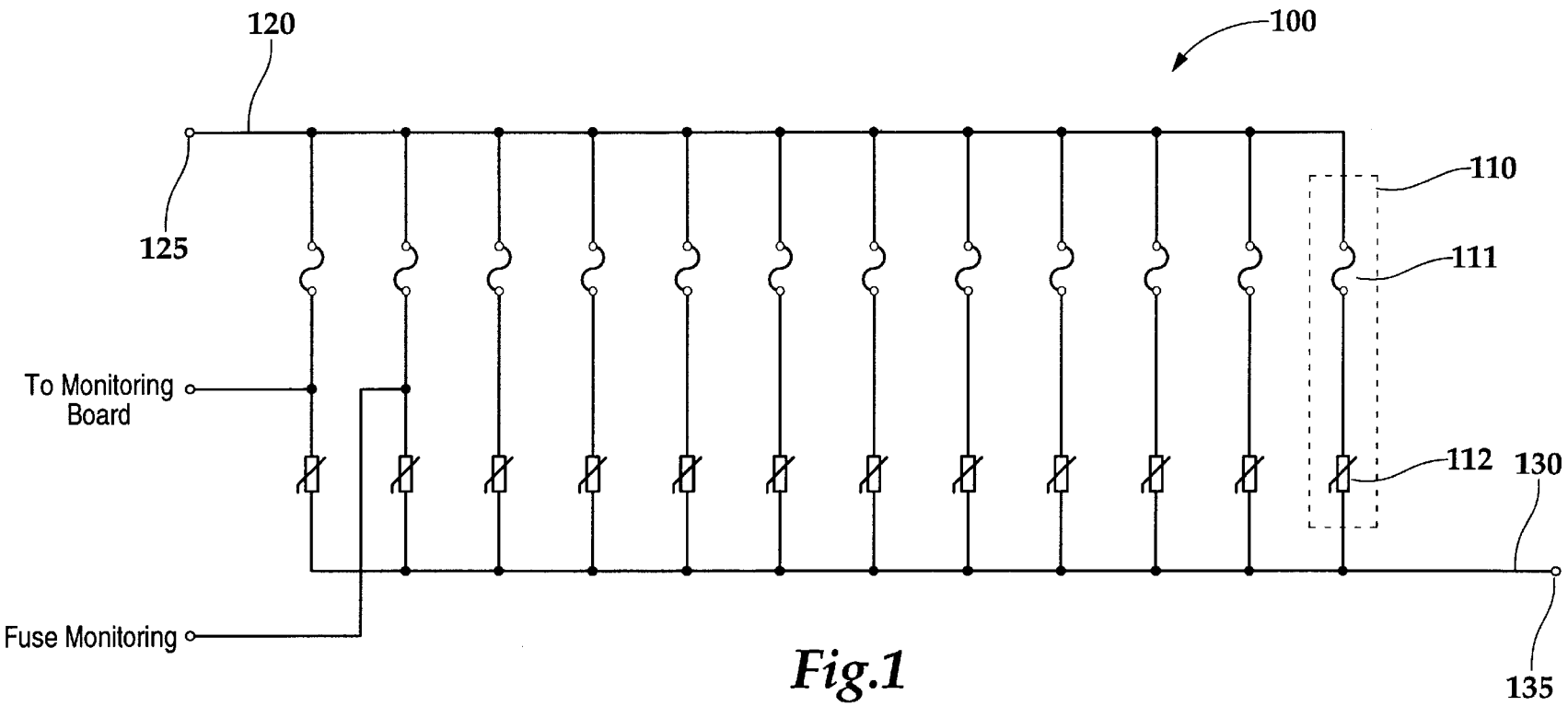
FIG. 1 illustrates a schematic of an exemplary transient-voltage suppression circuit.

Referring initially to FIG. 1, illustrated is an exemplary transient-voltage suppression circuit 100. The transient-voltage suppression circuit 100 includes a plurality of parallel-coupled circuits, generally designated 110, each of which includes a current-limiting element 111 and a transient-suppressing element 112. Those skilled in the art will readily appreciate that the transient-voltage suppression circuit 100 may have any desired number of the parallel-coupled circuits 110, and that the total transient-suppressing capacity of the transient-voltage suppression circuit 100 is a function of the number of parallel-coupled circuits 110.

In the exemplary transient-voltage suppression circuit 100, the current-limiting elements 111 are fuses, or thermal cutoffs, and the transient-suppressing elements 112, which are each coupled in series with a thermal cutoff 111, are metal oxide varistors ("MOV"). Each series-coupled thermal cutoff 111 and MOV 112 is coupled between a bus 120 and a bus 130. The bus 120 is couplable to a first electrical conductor of a power distribution system (not shown) via terminal 125, and the bus 130 is couplable to a second electrical conductor of the power distribution system via terminal 135; the first and second electrical conductors may be, for example, a phase and neutral conductor (or phase and ground conductor), respectively. An electrical load (not shown) to be protected by the transient-voltage suppression circuit 100 would also be coupled to the first and second electrical conductors. When exposed to a transient voltage occurring between the electrical conductors of a power distribution system to which transient-voltage suppression circuit 100 is coupled, the impedance of each MOV 112 changes by many orders of magnitude from a substantially high-impedance state to a very low impedance state, i.e., a highly conductive state, thereby "shunting" the current associated with the transient voltage through the MOV and thus away from the sensitive electronic hardware to be protected. Thus, the MOVs can be electrically connected in parallel between electrical conductors of a power distribution system to provide protection from transient voltages to an electrical load also coupled to the electrical conductors.

As those skilled in the art understand, when an MOV is subjected to a transient voltage beyond its peak current/energy rating, it initially fails in a short-circuit mode. An MOV may also fail when operated at a steady-state voltage well beyond its nominal voltage rating, or if subjected to repeated operations due to transient voltages having associated current levels below the peak current/energy rating for the MOV. When an MOV fails in the short-circuit mode, the current through the MOV becomes limited mainly by the source impedance of the power distribution system to which the MOV is coupled. Consequently, a large amount of energy can be introduced into the MOV, causing the MOV to become very hot, which can result in mechanical rupture of the MOV package accompanied by expulsion of package material; this failure mode may be prevented by proper selection of a current-limiting element that "clears" the fault. The current-limiting element 111 is preferably selected to interrupt the fault current that is caused to flow through the MOV 112 (as well as the current-limiting element) due to the failure of the MOV.

In many conventional transient-voltage suppression circuits, a bare fusible element, such as an uninsulated copper wire, is often used as a current-limiting element in series with MOV transient suppressing elements. The bare fusible elements are typically mounted on a printed circuit board to which the MOVs are also mounted. It has been recognized that when such bare fusible elements are mounted in close proximity, the electrical arcing resulting from the open-circuiting of one fusible element can cause damage to other adjacent fusible elements, as well as other adjacent electrical components. The damage caused to an adjacent fusible element may cause that element to open-circuit, thereby eliminating an additional MOV from the circuit and degrading the overall transient suppression capacity of the circuit. Furthermore, the electrical arcing of a fusible element can cause arc "tracking" on the circuit board; the electrical arcing results in carbon deposition on the circuit board, thus forming a conductive path, or "track," which helps to sustain the electrical arc and prevent clearing of the fault. In circuits that employ a thermal couple as a current-limiting element, the heat generated by a failed, or failing MOV, can interfere with the desired operation of the thermal couple. These types of problems, and others, are addressed by certain inventions disclosed herein.

Figure 2:
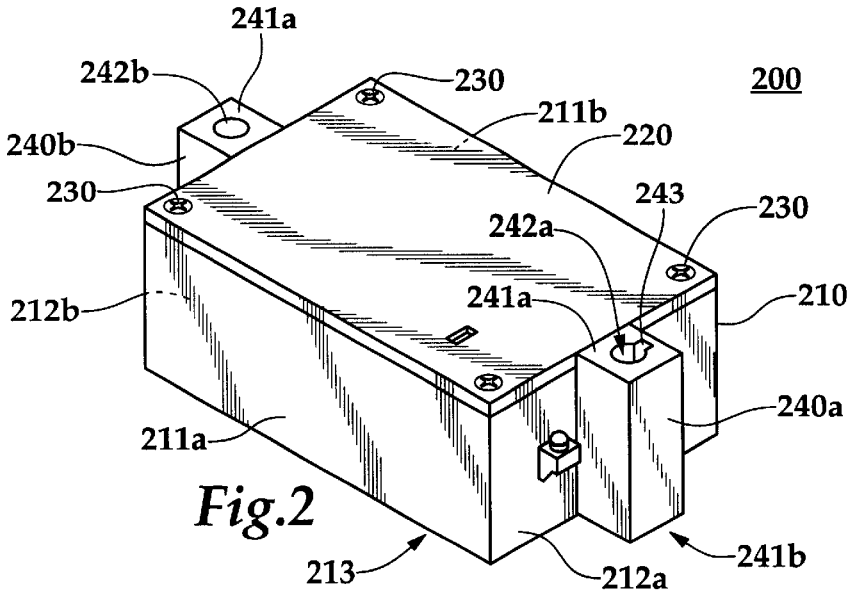
FIG. 2 illustrates an isometric view of an exemplary module for housing the transient-voltage suppression circuit illustrated in FIG. 1.

Turning now to FIG. 2, illustrated is an isometric view of an exemplary module 200 in accordance with principles of an invention disclosed herein; the module 200 can house, for example, the transient-voltage suppression circuit 100 illustrated in FIG. 1. Module 200 includes a body 210 having a lid 220 secured thereto by screws 230. The body 210 has opposing sidewalls 211*a*, 211*b* (hidden), opposing endwalls 212*a*, 212*b* (hidden), and a bottom 213 (hidden) that form a substantially rectangular enclosure. The body 210 and lid 220 are preferably constructed from a non-conductive material.

At either end of body 210 are electrically-conductive bus portions 240*a*, 240*b*; the bus portions 240*a*, 240*b* each include an electrically-conductive tab (not shown), described infra, that passes through the respective endwalls 212*a*, 212*b* for coupling to an electrical circuit housed within module 200. The bus portions 240*a*, 240*b* can be machined, for example, from solid copper or brass. In the exemplary embodiment, the bus portions 240*a*, 240*b* each have a substantially square cross-section and extend from a location proximate the lid 220 to the bottom 213 of enclosure 200. At either end of bus portions 240*a*, 240*b* are substantially flat opposing faces, or contact surfaces, 241*a* and 241*b* (hidden). Extending longitudinally through each bus portion 240*a*, 240*b* are bores 242*a*, 242*b*, respectively. As described hereinafter, the bores 242*a*, 242*b* provide a means for one or more modules 200 to be slidably-mounted in a stacked arrangement. In certain embodiments, it can be desirable to "key" the module 200 such that it can only be mounted in a particular orientation. In the exemplary embodiment, module 200 is keyed by including a channel 243 that extends along bore 242*a*; the channel 243 corresponds to a pin on one of the two required mounting posts (described infra), such that the module 200 can only be mounted in a desired position. In an assembled device containing one or more modules 200 (as described more fully infra), the contact surfaces 241*b* can engage, or mate against, either a surface of a mounting substrate, such as printed circuit board (PCB), or a contact surface 241*a* of an adjacent module 200 in a stack of such modules. When two or more modules 200 are stacked, the bus portions 240*a*, 240*b* of each module thereby form a bus structure that provides electrical conductivity from module to module.

Figure 3:
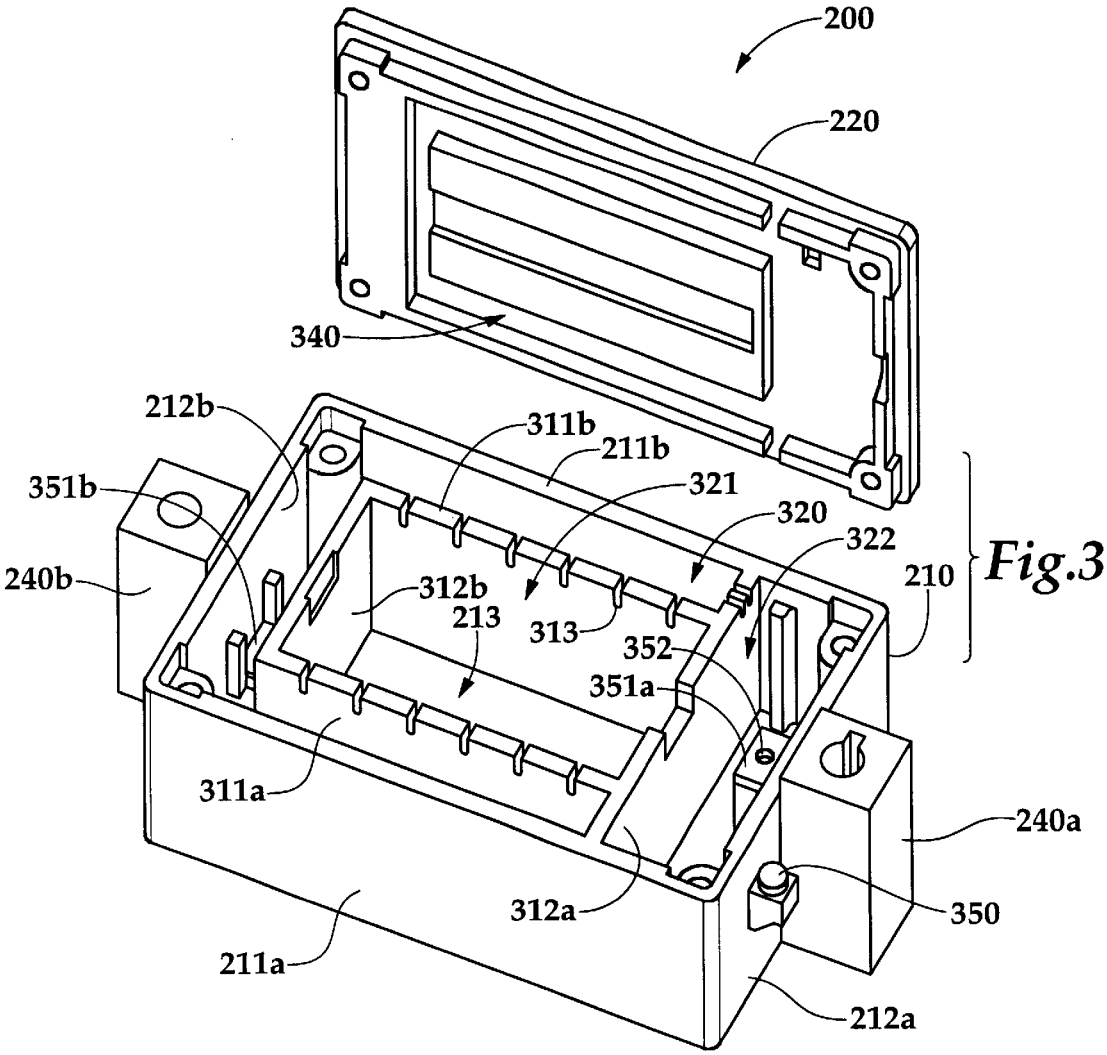
FIG. 3 illustrates an isometric view of the internal structure of the exemplary module.

Turning now to FIG. 3 (with continuing reference to FIG. 1), illustrated is an isometric view of the internal structure of the exemplary module 200, in accordance with principles of an invention disclosed herein. As noted previously, a failure of an MOV can result in electrical arcing and the generation of tremendous heat that can undesirably affect the operation of an associated current-limiting element. The exemplary internal structure of module 200 illustrated in FIG. 3 addresses this problem. As illustrated in FIG. 3, module 200 includes an internal wall structure including internal opposing sidewalls 311*a*, 311*b*, and internal opposing endwalls 312*a*, 312*b*; each of the internal walls extends upwardly from the bottom 213 of module 200. According to the principles of an invention disclosed herein, the internal walls divide the internal compartment of module 200 into at least first and second chambers 320, 321; i.e., the chamber 320 is intermediate to the external and internal walls, and the chamber 321 is formed within the internal walls. Preferably, the lid 220 includes a groove 340 that engages the upper edges of internal opposing sidewalls 311*a*, 311*b*, and internal opposing endwalls 312*a*, 312*b* when coupled to the body 210; the groove 340 can serve to further isolate the first and second chambers 320, 321.

As previously noted, the bus portions 240*a*, 240*b* each include an electrically-conductive tab that passes through the respective endwalls 212*a*, 212*b* for coupling to an electrical circuit housed within module 200. As illustrated in FIG. 3, bus portion 240*a* has a tab 351*a*, and bus portion 240*b* has a tab 351*b*. Each tab includes a threaded hole 352 (one shown) for coupling to bus bars associated with an electrical circuit mounted in the module 200 (described more fully with reference to FIGS. 4, 5 and 6, infra).

In the exemplary embodiment illustrated in FIG. 3, the internal sidewalls 311*a*, 311*b* include a series of slits, generally designated 313, along an upper edge of the walls proximate the plane in which the lid 220 occupies when coupled to the body 210. These slits 313 can function as passageways for electrical leads intermediate to electrical components housed within the separate chambers 320, 321. For example, for the circuit 100 illustrated in FIG. 1, the MOVs 112 can be housed within chamber 321, while the current-limiting elements 111 coupled in series with the MOVS can be housed within chamber 320; the electrical lead that couples each MOV 112 to its associated current-limiting element 111 can be routed through a slit 313, whereby the MOVs 112 are isolated within chamber 321 from the current-limiting elements 111 within chamber 320.

As also shown in FIG. 3, internal endwall 312*a* extends from sidewall 211*a* to sidewall 211*b*, whereby a third chamber 322 is formed within module 200; i.e., chamber 322 is bounded by a portion of sidewalls 211*a*, 211*b*, endwall 212*a*, and internal endwall 312*a*. This third chamber 322 can be used, for example, to isolate other electronic circuitry from, for example, the MOVs disposed in chamber 320 and the current-limiting elements disposed in chamber 321. For example, monitoring circuitry can be provided to indicate the operational status of one or more of the MOVs or current-limiting elements. The isolation of such status circuitry can be very important because if the status circuitry is not properly insulated from the electrical arcing and/or heat associated with the failure of an MOV or current-limiting element, the status circuitry itself can be damaged and fail to properly provide a failure indication. The status circuitry can, for example, provide an external visual indication of a failure, such as by illuminating (or extinguishing) a light emitting diode (LED) 350 provided external to module 200. Those skilled in the art are familiar with various monitoring circuits suitable for transient voltage suppression circuits; see, for example, U.S. Pat. No. 5,914,662, issued to Roger S. Burleigh, which is commonly assigned with the instant application and incorporated herein by reference.

Figure 4:
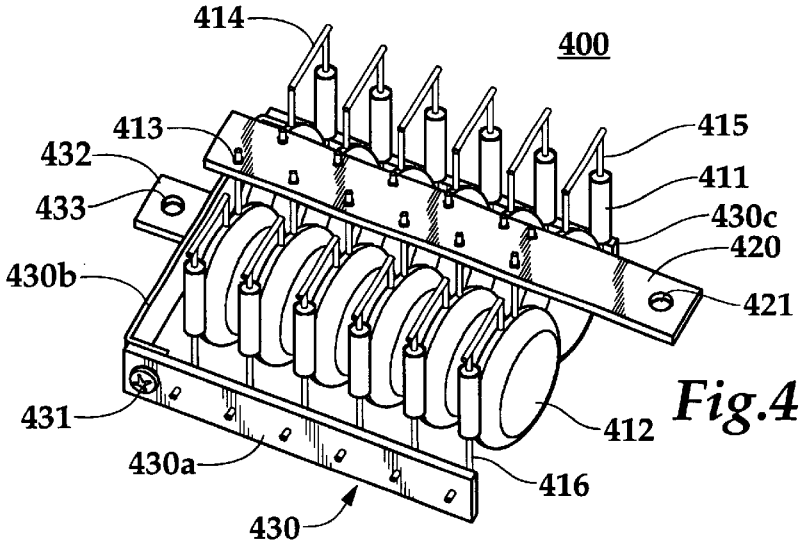
FIG. 4 illustrates an isometric view of the transient-voltage suppression circuit illustrated in FIG. 1 adapted to fit the internal structure of the exemplary module.

Turning now to FIG. 4 (with continuing reference to FIGS. 1 and 3), illustrated is an exemplary physical structure of the transient-voltage suppression circuit 100, illustrated in FIG. 1, adapted to fit the internal structure of the exemplary module 200. The MOVs 412 (corresponding to the MOVs 112 of FIG. 1) are centrally arranged to be housed within chamber 321 of module 200. A first terminal 413 of each MOV 412 is coupled to a first bus bar 420. The first bus bar 420 includes a hole 421 at one end through which a screw (not shown) can be inserted to couple the first bus bar 420 to tab 351*a* associated with bus portion 240*a*. The first bus bar 420 can be, for example, solid copper or brass; alternatively, the first bus bar 420 can be a PCB having appropriate circuit traces to electrically couple each of the first terminals 413.

A second terminal 414 of each MOV 412 is coupled to a first terminal 415 of a corresponding current-limiting element 411; the terminals can be coupled, for example, by soldering. A second terminal 416 of each current-limiting element 411 is coupled to a second bus bar 430. In the exemplary embodiment, second bus bar 430 is constructed from separate bus bar portions 430*a*, 430*b* and 430*c* that are joined by coupling means 431; such coupling means can be, for example, a rivet or a bolt and nut. The second bus bar 430 (or bus bar portions 430*a*, 430*b*, 430*c*) can be, for example, solid copper or brass. Alternatively, bus bar portions 430*a* and 430*c* can each be a PCB having appropriate circuit traces to electrically couple each of the second terminals 416 of current-limiting elements 411, and the bus bar portion 430*b* can be a solid conductor. The bus bar portion 430*b* includes a tab 432 having a hole 433 through which a screw (not shown) can be inserted to couple the second bus bar 430 to tab 351*b* associated with bus portion 240*b* (see FIG. 3).

Figure 5:
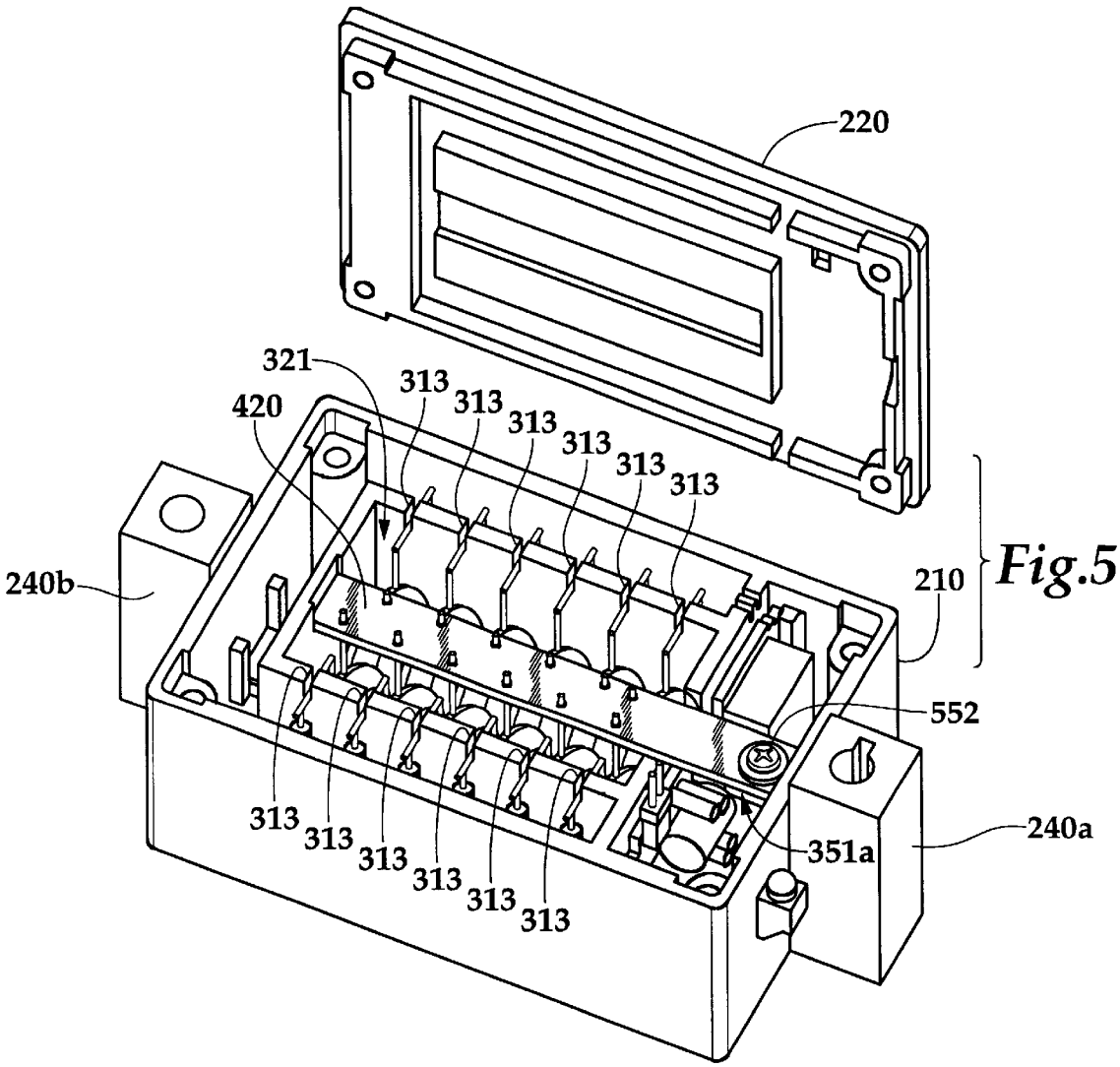
FIG. 5 illustrates an isometric view of the internal structure of the exemplary module, including therein the transient-voltage suppression circuit illustrated in FIG. 4.

Turning now to FIG. 5 (with continuing reference to FIGS. 2, 3 and 4), illustrated is an isometric view of the internal structure of the exemplary module 200, including therein the transient-voltage suppression circuit 400 illustrated in FIG. 4. As previously described, and as can be seen in FIG. 4, the slits 313 function as passageways for the electrical leads (or terminals) intermediate to the MOVs housed within chamber 321, and the current-limiting elements housed within chamber 320. In this exemplary embodiment, the second terminal 414 of each MOV 412 is bent to pass through a slit 313 into the chamber 320; within chamber 320, the second terminal 414 of each MOV 412 is soldered to the first terminal 415 of a corresponding current-limiting element 411. The first bus bar 420 is electrically and mechanically coupled to the tab 351*a* associated with bus portion 240*a* by a screw 552, and the second bus bar 430 is electrically and mechanically coupled to the tab 351*b* associated with bus portion 240*b* by a screw (hidden; see FIG. 6).

Figure 6:
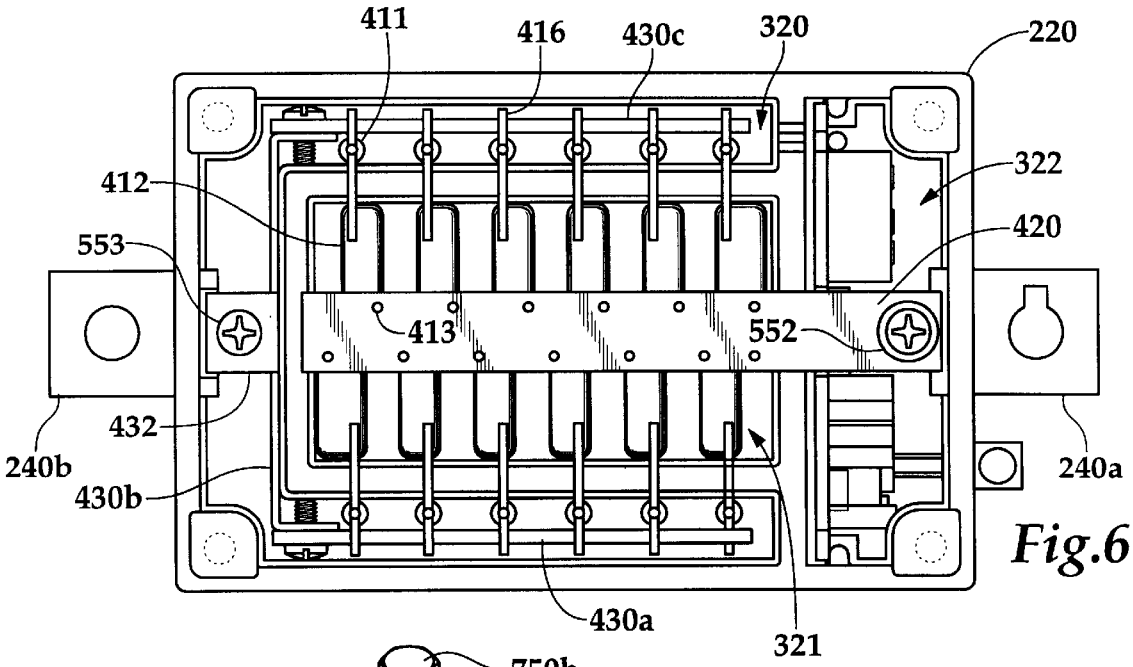
FIG. 6 illustrates a top view of the internal structure of the exemplary module, including therein the transient-voltage suppression circuit illustrated in FIG. 4.

Turning now to FIG. 6, (with continuing reference to FIGS. 2, 3 and 4), illustrated is a top view of the internal structure of the exemplary module 200, including therein the transient-voltage suppression circuit 400 illustrated in FIG. 4 (this figure provides details not readily seen in FIGS. 4 and 5). As can be seen readily in this figure, the MOVs 412 are all located within chamber 321, while the current-limiting elements 411 are all located within chamber 320. The common first terminals 413 of each MOV 412 are electrically and mechanically coupled to first bus bar 420, which is electrically and mechanically coupled to tab 351*a* of bus portion 240*a* by a screw 552. Similarly, the second terminals 416 of each current-limiting element 411 are electrically and mechanically coupled to second bus bar 430 (comprised of bus bar portions 430*a*, 430*b* and 430*c*), and the tab 432 of second bus bar 430 is electrically and mechanically coupled to tab 351*b* of bus portion 240*b* by a screw 553. In a preferred embodiment, the chambers 320, 321 and 322 are filled with arc-quenching desiccated sand prior to sealing module 200 by securing lid 220.

Figure 7:
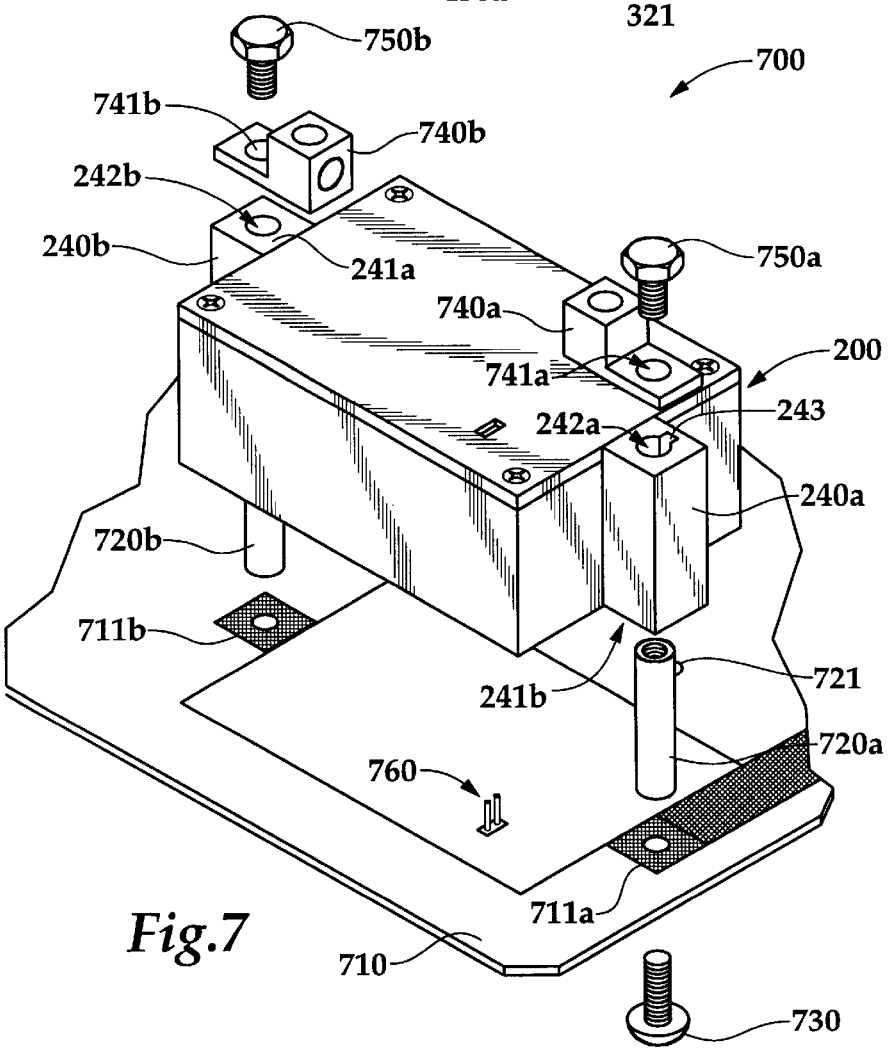
FIG. 7 illustrates an isometric view of a structure for mounting a single exemplary module (per mode of protection) to a mounting substrate.

Now, turning to FIG. 7, illustrated is an isometric view of an exemplary structure 700 for mounting a single module 200 (per mode of protection) to a mounting substrate 710. Mounting posts 720*a*, 720*b*, which can be internally threaded, are secured perpendicularly to the substrate 710 by bolts 730 (one shown) that pass through substrate 710. The mounting posts 720*a*, 720*b* are disposed at a distance corresponding to the distance between bores 242*a*, 242*b* of bus portions 240*a*, 240*b*, respectively, of module 200. The mounting posts 720*a*, 720*b* have an external diameter substantially equal to the internal diameter of bores 242*a*, 242*b*, and provide a means for module 200 to be slidably-mounted thereon. In certain embodiments, it can be desirable to "key" the module 200 such that it can only be mounted within a device in a particular orientation. In the exemplary embodiment, module 200 is keyed by including a channel 243 that extends along bore 242*a*; the channel 243 corresponds to a pin 721 on mounting post 720*a*, such that the module 200 can only be mounted in a desired position. Once module 200 is slid onto mounting posts 720*a*, 720*b*, it is secured in place by bolts 750*a*, 750*b*, which screw into the mounting posts. Preferably, the mounting posts 720*a*, 720*b* have a length slightly less than the length of bus portions 240*a*, 240*b*, respectively; the difference in length allows for the module 200 to be securely compressed against the substrate 710 when bolts 750*a*, 750*b* are tightened.

As described supra, module 200 houses an electrical circuit, such as transient voltage suppression circuit 100 that is to be coupled between two electrical conductors, such as phase and neutral, phase and ground, or neutral and ground conductors. To accomplish this, means are provided to couple the bus portions 240*a*, 240*b* to the desired conductors. In one embodiment, this can be accomplished by providing electrical circuit traces, or "contact pads," 711*a*, 711*b*, on PCB 710. The contact pads 711*a*, 711*b* are electrically coupled to contact surfaces 241*b* (hidden) at the lower ends of bus portions 240*a*, 240*b* when module 200 is slid onto mounting posts 720*a*, 720*b* and seated against PCB 710. Alternatively, or in combination with contact pads 711*a*, 711*b*, electrical conductor coupling means can be provided proximate the contact surfaces 241*a* at the upper ends of bus portions 240*a*, 240*b*. For example, the coupling means can be conventional compression lugs 740*a*, 740*b*. The compression lugs 740*a*, 740*b* have mounting holes 741*a*, 741*b*, respectively, through which bolts 750*a*, 750*b* pass before being screwed into the mounting posts 720*a*, 720*b*, thereby securing the compression lugs mechanically, and electrically coupling them to the contact surfaces 241*a*, 241*b* at the upper ends of bus portions 240*a*, 240*b*.

Figure 8:
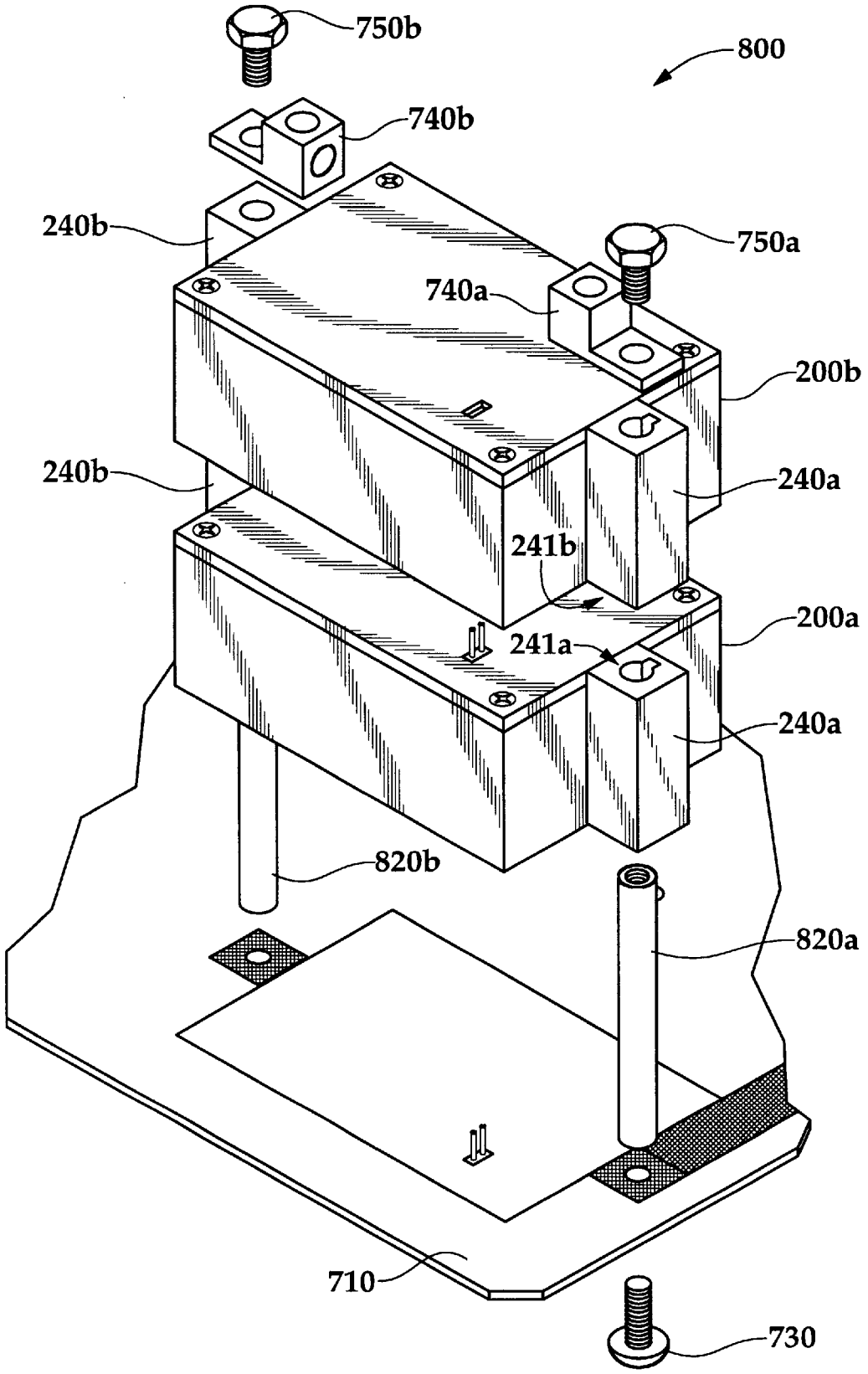
FIG. 8 illustrates an isometric view of a structure for mounting two exemplary modules (per mode of protection) to a mounting substrate.

Turning now to FIG. 8, illustrated is an isometric view of an exemplary structure 800 for mounting two exemplary modules (per mode of protection) 200*a*, 200*b* to a mounting substrate 710. The exemplary structure 800 is identical to structure 700, with the single exception that mounting posts 820*a*, 820*b* have a length substantially equal to the combined length of two bus portions 240*a*, such that two modules 200*a*, 200*b* can be slid thereon. In this embodiment, the modules 200*a*, 200*b* are electrically coupled, in parallel, through the surface contact of the contact surfaces 241*a* (one shown; one hidden), at the upper ends of the bus portions 240*a*, 240*b* of module 200*a* with the contact surfaces 241*b* (hidden) at the lower ends of the bus portions 240*a*, 240*b* of module 200*b*. Thus, when modules 200*a* and 200*b* are stacked, the bus portions 240*a*, 240*b* of each module form a bus structure that provides electrical conductivity from module to module. Preferably, the mounting posts 820*a*, 820*b* have a length slightly less than the combined lengths of two bus portions 240*a* (and 240*b*); the difference in length allows for the modules 200*a*, 200*b* to be securely compressed against the substrate 710 when bolts 750*a*, 750*b* are tightened, while also ensuring good electrical contact between the contact surfaces 241*a* and 241*b* of bus portions 240*a*, 240*b* of the adjacent modules 200*a*, 200*b*, respectively.

Figure 9:
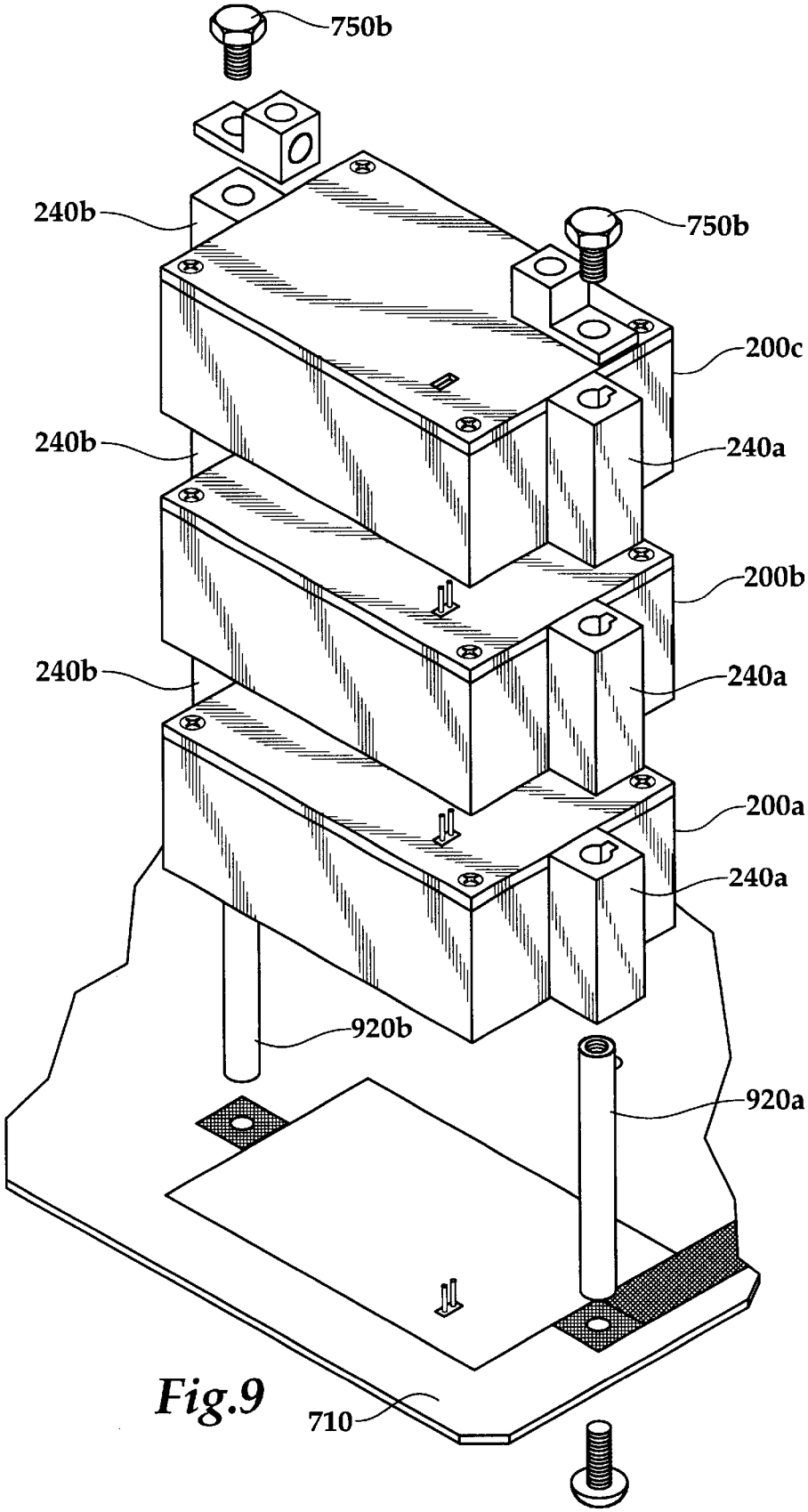
FIG. 9 illustrates an isometric view of a structure for mounting three exemplary modules (per mode of protection) to a mounting substrate.

Turning now to FIG. 9, illustrated is an isometric view of an exemplary structure 900 for mounting three exemplary modules (per mode of protection) 200*a*, 200*b*, and 200*c* to a mounting substrate 710. The exemplary structure 900 is identical to structure 700 (and 800), with the single exception that mounting posts 920*a*, 920*b* have a length substantially equal to (or slightly less than) the combined length of three bus portions 240*a*, such that three modules 200*a*, 200*b* and 200*c* can be slid thereon. Those skilled in the art will recognize that the principles described herein disclose a novel structural approach to mounting any number of modules 200. The novel structure is particularly advantageous for the parallel coupling of transient voltage suppression circuits, because it does not require any additional hardware to mount each additional module, which simplifies both manufacture and disassembly for the repair or replacement of a module if its internal circuitry fails. For example, if module 200*a* fails, it is only necessary to 1) remove bolts 750*a*, 750*b*, 2) slide modules 200*c*, 200*b* and 200*a* off of mounting posts 920*a*, 920*b*, 3) replace module 200*a* with a functional module, slide modules 200*a*, 200*b* and 200*c* back onto mounting posts 920*a*, 920*b*, and 4) secure bolts 750*a*, 750*b*.

Although the exemplary structures 700, 800 and 900 are characterized by modules 200 having bus portions 240*a*, 240*b* that provide both the mechanical and electrical means for coupling multiple modules, the principles of the present invention are not so limited. The main principle of this invention is the providing of one or more mounting posts, tracks, channels, or similar structures onto which one or more modules can be slidably-mounted; the electrical coupling of the modules is not necessarily provided by the same mechanical means. For example, electrical contact plates could be provided on the top and bottom of each module for electrical coupling to an adjacent module (or substrate), while a separate mechanical structure (or structures) can be provided for slidable engagement with one or more mounting posts, tracks, channels, or similar structures. Thus, the mechanical and electrical coupling features of the present invention are separable, without departing from the principles disclosed herein.

As described supra with reference to FIG. 1, multiple MOVs can be coupled in parallel combination such that the MOVs share the total current associated with a transient voltage. In this manner, each individual MOV must only conduct a fraction of the total transient current, thereby reducing the probability that any individual MOV will exceed its rated maximum transient current capacity. As also described supra, a circuit of parallel-coupled MOVs, such as circuit 100, can be enclosed in a module 200, and multiple modules can then be coupled in parallel. Although the teachings of the prior art have recognized that multiple modules can be coupled in parallel, the prior art has failed to recognize that the manner in which the modules are coupled can have an impact on the capability of an individual module to provide its full transient-suppressing capacity; i.e., the prior art structures for coupling multiple transient suppressing modules yield systems having a transient suppressing capacity less than the sum of the suppressing capacities of each module.

As illustrated in the transient-voltage suppression circuit 100 of FIG. 1, and the exemplary physical structure 400 of FIG. 4, the buses 120 and 130 (corresponding to bus bar 420 and 430, respectively) are physically opposed such that the electrical path length through all MOVs 112 are equal. The equal electrical path lengths ensure that all MOVs 112 will share the current associated with a transient voltage in substantially equal parts. For example, if ten parallel-coupled circuits 110 are provided, one tenth of the transient current will flow through each MOV 112. In prior art systems that have coupled multiple modules in parallel, however, the sharing of the transient current between MOVs in different modules has not been ensured. For example, in the prior art modular device disclosed in U.S. Pat. No. 5,701,227, the phase and neutral (or ground) conductors are both coupled to connections directly proximate the bottom module in a stack of modules. The modules that occupy positions above the lowest module will therefore have electrical path lengths through their internal components (e.g., MOVs) that are longer than the electrical path length through the lowest module and, therefore, the MOVs in the upper module(s) will not equally share a transient current with the MOVs in the lowest module.

Figure 10:
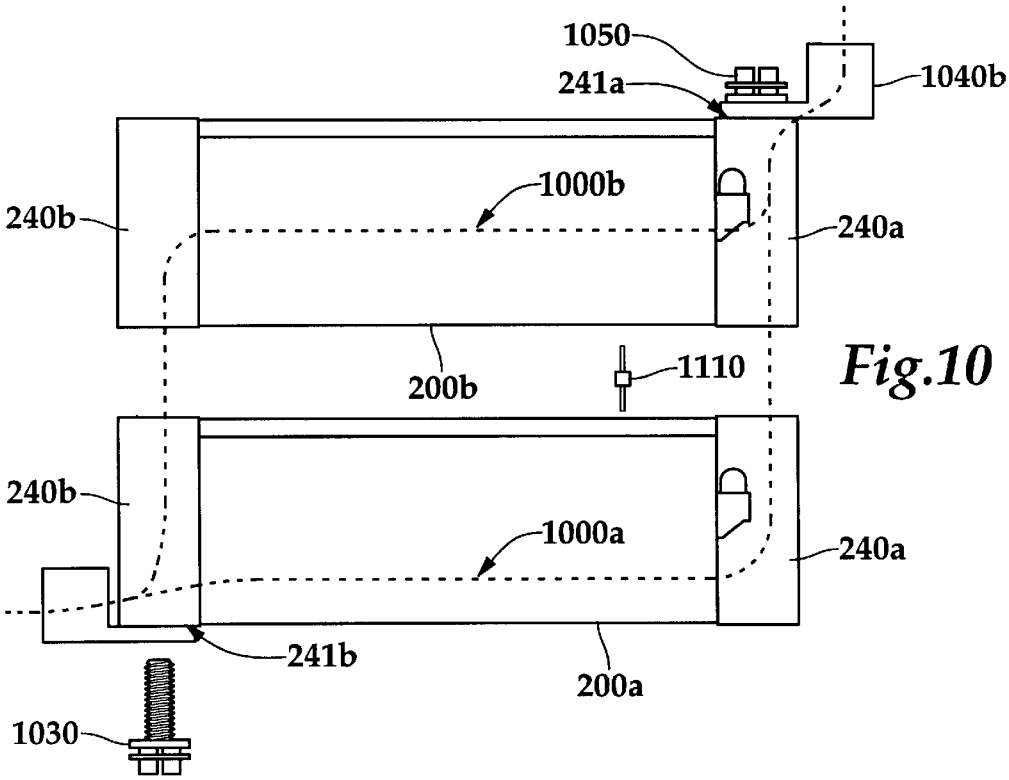
FIGS. 10-A and 10-B illustrate side views of an exemplary physical structure for mounting and interconnecting multiple modules, while ensuring that all electrical path lengths through each module are equalized.

Turning now to FIG. 10, illustrated is a side view of an exemplary physical structure for mounting and interconnecting multiple modules, while ensuring that all electrical path lengths through each module are equalized. As previously described, two modules 200*a* and 200*b* can be mounted in a stacked orientation, whereby the internal circuits are coupled in parallel electrically by the bus portions 240*a* and 240*b* of each module. As shown in FIG. 10, a first electrical conductor coupling means 1040*a*, such as a compression lug, is coupled proximate the lower contact surface 241*a* of bus portion 240*b* associated with module 200*a*, while a second electrical conductor coupling means 1040*b*, such as a compression lug, is coupled proximate the upper contact surface 241*a* of bus portion 240*a* associated with module 200*b*, whereby the electrical path lengths 1000*a* and 1000*b* through modules 200*a*, 200*b*, respectively, are of substantially equal length. Thus, each MOV in module 200*a* will share equally any transient current with each MOV in module 200*b*. Those skilled in the art will recognize that the exemplary structures 700, 800 and 900 can be readily adapted to provide such current sharing between all modules.

Figure 11:
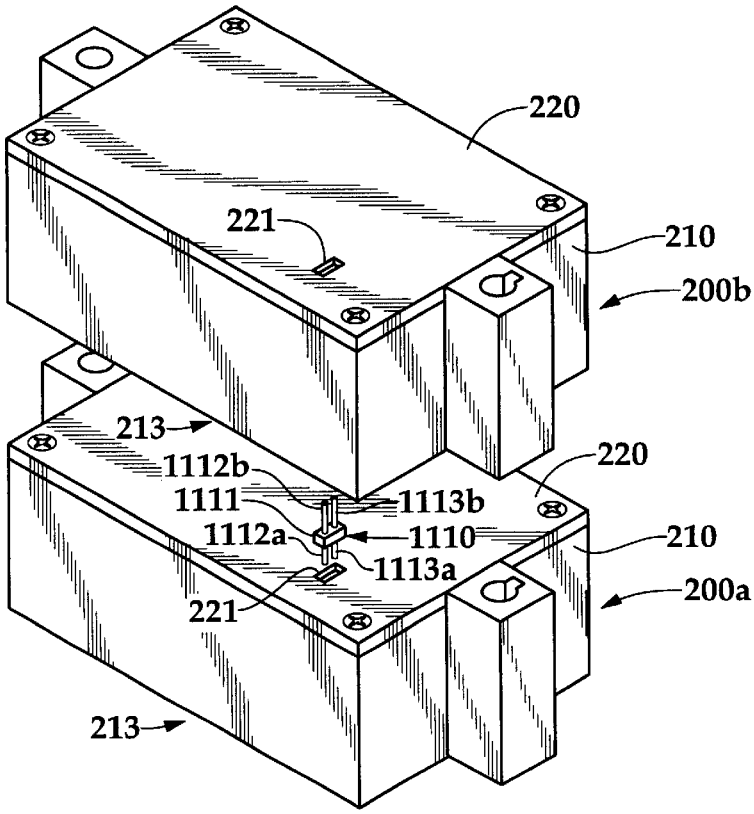
FIG. 11 illustrates an exploded isometric of a structure for interconnecting status ports between adjacent stacked modules.

Another problem in the prior art is how to monitor the status of multiple modules. In some prior art systems, independent monitoring circuits are provided in each module. The disadvantages of this approach are that a greater number of components must be housed within a module, and thus the size of a module must be increased, as well as adding additional cost to the system. In some prior art systems, monitoring conductors from each module are routed to an external monitoring circuit. The disadvantages of this approach are that adequate free space must be provided between modules in a stack, and/or between adjacent stacks of modules, to route the monitoring conductors to the monitoring circuit, thus increasing the size of the system, as well as an increase in the amount of labor necessary to assemble a system. FIG. 11 illustrates an exploded isometric of an exemplary structure for interconnecting status interfaces between adjacent stacked modules that overcomes these disadvantages of the prior art.

As illustrated in FIG. 11, two modules 200*a* and 200*b* are stacked according to the principles disclosed supra. To accommodate the communication of module status information between modules and/or other circuitry coupled to the modules via the mounting substrate, each module is provided with status ports for coupling status information between modules and/or the substrate. In the exemplary embodiment illustrated in FIG. 11, each module 200*a*, 200*b* includes an upper status port 221 in the lid 220, and a lower status port (hidden) in the bottom 213 of body 210. The upper status port 221 and lower status port can provide electrical connections from internal monitoring circuitry within a module to internal monitoring circuitry within each adjacent module, or simply provide a means of coupling monitoring signal points from within each module to external monitoring circuitry.

In one embodiment, a status interconnector 1110 is provided to couple the upper status port 221 of module 200*a* to the lower status port (hidden) of module 200*b*. The exemplary status interconnector 1110 includes a non-conductive central body 1111 through which two electrical pin conductors 1112, 1113 pass. The first ends 1112*a* and 1113*a* of each pin conductor 1112, 1113, respectively, are receivable by the upper status port 221 of module 200*a*; the second ends 1112*b* and 1113*b* of each pin conductor 1112, 1113, respectively, are receivable by the lower status port (hidden) of module 200*b*. As shown in FIG. 7, a status connector 760 can also be provided on substrate 710 to couple to the lower status port (hidden) on module 200*a*. Thus, all modules in a stack of modules can be easily interconnected for status monitoring purposes without the need for routing any external conductors, which allows adjacent stacks of modules to be closely packed together. Although illustrated as a separable component, those skilled in the art will recognize that status interconnector 1110, or a similar structure, can be integrated with each module; e.g., the lower status port of each module 220 can provide one or more electrical pin conductors to be received in the upper status port 221 of an adjacent module 220 (or substrate 710). Furthermore, the status interconnector 1110 can include any number of electrical pin conductors as required for a particular status monitoring circuit.

From the foregoing detailed description, it is apparent that the present application discloses improved modular structures for housing transient voltage suppression circuits. Although the present invention and its advantages have been described in detail, those skilled in the art should understand that they can make various changes, substitutions and alterations herein without departing from the spirit and scope of the invention in its broadest form.

We claim:

1. A modular transient voltage surge suppressor apparatus, comprising:

first and second transient voltage surge suppression modules, said second transient voltage surge suppression module being stacked on top of said first transient voltage surge suppression module, each of said first and second transient voltage surge suppression modules comprising:

a non-conductive housing having a surge suppression circuit contained therein; and first and second electrically-conductive buses mechanically coupled to said non-conductive housing and electrically coupled to first and second terminals of said surge suppression circuit, respectively;

first and second bus couplers, said first bus coupler coupling said first electrically-conductive buses of said first and second transient voltage surge suppression modules and said second bus coupler coupling said second electrically-conductive buses of said first and second transient voltage surge suppression modules, whereby said surge suppression circuits in each of said first and second modules are electrically coupled in parallel;

a first electrical conductor coupler electrically coupled to, and physically located proximate, said first electrically-conductive bus of said first transient voltage surge suppression module; and a second electrical conductor coupler electrically coupled to, and physically located proximate, said second electrically-conductive bus of said second transient voltage surge suppression module, whereby the electrical path length from said first electrical conductor coupler to said second electrical conductor coupler and through said surge suppression circuit of said first transient voltage surge suppression module is substantially equal to the electrical path length from said first electrical conductor coupler to said second electrical conductor coupler and through said surge suppression circuit of said second transient voltage surge suppression module.

2. The modular transient voltage surge suppressor apparatus recited in claim 1, further comprising a substrate, and wherein said first and second bus couplers comprise first and second mounting posts coupled to and extending substantially perpendicular to said substrate, said first and second electrically-conductive buses of said first and second transient voltage surge suppression modules comprising a bore therethrough for slidably mounting said transient voltage surge suppression modules on said mounting posts, said bore having an internal profile corresponding to an external profile of said mounting posts, said first transient voltage surge suppression module being mounted on said first and second mounting posts adjacent to said substrate and said second transient voltage surge suppression module being mounted on said first and second mounting posts adjacent to said first transient voltage surge suppression module.

3. The modular transient voltage surge suppressor apparatus recited in claim 2, wherein each of said first and second electrically-conductive buses extend from locations proximate the upper and bottom portions of said housing of said first and second transient voltage surge suppression modules, each of said electrically-conductive buses comprising a lower contact surface and an upper contact surface, said lower contact surfaces of said first and second electrically-conductive buses of said second transient voltage surge suppression module engaging the upper contact surfaces of corresponding first and second electrically-conductive buses of said first transient voltage surge suppression module.

4. The modular transient voltage surge suppressor apparatus recited in claim 2, wherein said substrate comprises a printed circuit board.

5. The modular transient voltage surge suppressor apparatus recited in claim 2, wherein an end of each of said first and second mounting posts proximate said substrate is internally threaded, said mounting posts being coupled to said substrate by a bolt passing through said substrate.

6. The modular transient voltage surge suppressor apparatus recited in claim 2, wherein said first and second transient voltage surge suppression modules include keying means for ensuring that said modules are slidably-mounted on said first and second mounting posts in a predefined orientation.

7. The modular transient voltage surge suppressor apparatus recited in claim 6, wherein at least one of said first and second mounting posts includes a key pin, said key pin corresponding to a channel extending longitudinally along said bore of a corresponding one of said first and second electrically-conductive buses of each of said first and second transient voltage surge suppression modules.

8. The modular transient voltage surge suppressor apparatus recited in claim 2, wherein an end of each of said first and second mounting posts distal to said substrate is internally threaded, said first and second transient voltage surge suppression modules being secured on said first and second mounting posts by first and second bolts threadably inserted into said end of each of said first and second mounting posts distal to said substrate.

9. The modular transient voltage surge suppressor apparatus recited in claim 1, wherein said first and second electrical conductor couplers comprise compression lugs.

10. A modular transient voltage surge suppressor apparatus, comprising:

a substrate;

first and second mounting posts coupled to and extending substantially perpendicular to said substrate;

first and second transient voltage surge suppression modules, each of said first and second transient voltage surge suppression modules comprising:

a non-conductive housing having a surge suppression circuit contained therein; and first and second electrically-conductive buses mechanically coupled to said non-conductive housing and electrically coupled to first and second terminals of said surge suppression circuit, respectively, said first and second electrically-conductive buses comprising a bore therethrough for slidably mounting said transient voltage surge suppression modules on said first and second mounting posts, said bore having an internal profile corresponding to an external profile of said mounting posts;

wherein said first transient voltage surge suppression module is mounted on said first and second mounting posts adjacent to said substrate and said second transient voltage surge suppression module is mounted on said first and second mounting posts adjacent to said first transient voltage surge suppression module, whereby said surge suppression circuits in each of said first and second modules are electrically coupled in parallel;

a first electrical conductor coupler electrically coupled to, and physically located proximate, said first electrically-conductive bus of said first transient voltage surge suppression module; and a second electrical conductor coupler electrically coupled to, and physically located proximate, said second electrically-conductive bus of said second transient voltage surge suppression module, whereby the electrical path length from said first electrical conductor coupler to said second electrical conductor coupler and through said surge suppression circuit of said first transient voltage surge suppression module is substantially equal to the electrical path length from said first electrical conductor coupler to said second electrical conductor coupler and through said surge suppression circuit of said second transient voltage surge suppression module.

11. The modular transient voltage surge suppressor apparatus recited in claim 10, wherein each of said first and second electrically-conductive buses extend from locations proximate the upper and bottom portions of said housing of said first and second transient voltage surge suppression modules, each of said electrically-conductive buses comprising a lower contact surface and an upper contact surface, said lower contact surfaces of said first and second electrically-conductive buses of said second transient voltage surge suppression module engaging the upper contact surfaces of corresponding first and second electrically-conductive buses of said first transient voltage surge suppression module.

12. The modular transient voltage surge suppressor apparatus recited in claim 10, wherein said substrate comprises a printed circuit board.

13. The modular transient voltage surge suppressor apparatus recited in claim 10, wherein an end of each of said first and second mounting posts proximate said substrate is internally threaded, said mounting posts being coupled to said substrate by a bolt passing through said substrate.

14. The modular transient voltage surge suppressor apparatus recited in claim 10, wherein said first and second transient voltage surge suppression modules include keying means for ensuring that said modules are slidably-mounted on said first and second mounting posts in a predefined orientation.

15. The modular transient voltage surge suppressor apparatus recited in claim 14, wherein at least one of said first and second mounting posts includes a key pin, said key pin corresponding to a channel extending longitudinally along said bore of a corresponding one of said first and second electrically-conductive buses of each of said first and second transient voltage surge suppression modules.

16. The modular transient voltage surge suppressor apparatus recited in claim 10, wherein an end of each of said first and second mounting posts distal to said substrate is internally threaded, said first and second transient voltage surge suppression modules being secured on said first and second mounting posts by first and second bolts threadably inserted into said end of each of said first and second mounting posts distal to said substrate.

17. The modular transient voltage surge suppressor apparatus recited in claim 10, wherein said first and second electrical conductor couplers comprise compression lugs.

* * * * *